US005334086A

United States Patent [19]

Sano et al.

[11] Patent Number: 5,334,086

[45] Date of Patent: Aug. 2, 1994

[54] APPARATUS FOR HIGH VOLTAGE TREATMENT OF CATHODE RAY TUBE

[75] Inventors: Kinjiro Sano; Wataru Imanishi; Yoshihisa Nakajima; Masaaki Kinoshita, all of Nagaokakyo, Japan

[73] Assignee: Mitsubishi Denki Kabushiki Kaisha, Tokyo, Japan

[21] Appl. No.: 73,675

[22] Filed: Jun. 8, 1993

Related U.S. Application Data

[60] Division of Ser. No. 912,138, Jul. 9, 1992, Pat. No. 5,252,098, which is a continuation of Ser. No. 672,869, Mar. 20, 1991, abandoned.

[30] Foreign Application Priority Data

Mar. 20, 1990 [JP] Japan ..... 2-71378
Mar. 27, 1990 [JP] Japan ..... 2-77571
Oct. 8, 1990 [JP] Japan ..... 2-270741

[51] Int. Cl.[5] ..... H01J 9/44
[52] U.S. Cl. ..... 445/62; 445/72
[58] Field of Search ..... 445/5, 6, 16, 17, 18, 445/40, 62, 63, 72

[56] References Cited

U.S. PATENT DOCUMENTS 3,323,854 6/1967 Palac .
4,052,776 10/1977 Maskell et al. ..... 445/5
4,073,558 2/1978 Benda et al. ..... 445/40
4,395,242 7/1983 Liller et al. ..... 445/5
4,515,569 5/1985 Hernqvist ..... 445/5

FOREIGN PATENT DOCUMENTS

2820516C2 2/1987 Fed. Rep. of Germany .
54-101255 9/1979 Japan .
54-116873 9/1979 Japan ..... 445/5
2-46624 2/1990 Japan ..... 445/5
2-227935 9/1990 Japan ..... 445/5

*Primary Examiner*—P. Austin Bradley
*Assistant Examiner*—Jeffrey T. Knapp

[57] ABSTRACT

An apparatus for the high voltage treatment for a cathode ray tube including a neck having one end closed with a stem and housing an electron gun and stem pins for a focus electrode and other electrodes of the electron gun, establishes a high pressure gas atmosphere around the neck, and establishes a voltage which is sufficiently higher than the operating voltage of the cathode ray tube between the stem pins when the high pressure gas atmosphere. In order to prevent a creeping discharge due to the voltage applied to the stem pins, the temperature of the neck is maintained above the temperature of said high pressure gas atmosphere during the voltage application. In an alternative method, the dew point of the high pressure gas atmosphere is set at, at most, 25° C.

17 Claims, 15 Drawing Sheets

APPARATUS FOR HIGH VOLTAGE TREATMENT OF CATHODE RAY TUBE

This application is a division of copending application Ser. No. 07/912,138, filed on Jul. 9, 1992, which is now U.S. Pat. No. 5,252,098, which is a continuation of application Ser. No. 07/672,869 filed on Mar. 20, 1991, now abandoned; the entire contents of which are hereby incorporated by reference.

FIELD OF THE INVENTION

This invention concerns a method of high voltage treatment for cathode ray tubes wherein a high voltage is applied from the stem pins to confer good dielectric properties, and an apparatus for implementing the treatment.

BACKGROUND OF THE INVENTION

FIG. 13 is a sectional view of the neck of a cathode ray tube.

In the figure, a cathode ray tube 20 includes a neck 1. A free end of the neck 1 closed by a stem 2, and this neck 1 houses an electron gun 10. The electron gun 10 includes a heater 11, cathode 12, first grid 13, second grid 14, third grid 15, which serves as a focus electrode, and fourth grid 16, these components being arranged in the stated order and held at specified intervals by insulating glass rods 17.

In for example the case of a 29" color cathode ray tube, when the cathode ray tube is operated, a high voltage of 28 kV is applied to fourth grid 16 of electron gun 10 via inner conducting film 3 and contactors 18 from an external anode button (not shown).

A high voltage of 6.7 kV is simultaneously applied to third grid 13 via a socket (not shown), stem pin 4*a* of third grid 15 and inner lead 19. Further, a voltage of about 700 V is applied to second grid 14, a voltage of about 150 V is applied to cathode 12, and a voltage of 0 V is normally applied to first grid 13.

Under these operating conditions, a potential difference of about 6 kV is set up between third grid 15 and second grid 14. If there is any burrs or flashes on the surface of that part of second grid 14 opposite to third grid 15 produced in the shaping (or forming) of the electrode or the manufacture of the electron gun 10, or if there is any dirt adhering to the interior of the cathode ray tube, stray emission of unwanted electrons may occur.

These unwanted electrons pass through the fourth grid 16, irradiate the surface of the cathode ray tube and cause it to fluoresce unnecessarily. This unnecessary fluorescence moreover occurs even when the screen is dark, and leads to a deterioration of image quality.

In order to prevent this emission of unwanted electrons, a voltage of four to five times the operating voltage of the cathode ray tube, i.e. a high voltage of about 30 kV, is applied from the outside between stem pin 4*a* of third grid 15 and the other stem pins 4*b*, during the manufacture of the cathode ray tube 20 as shown in FIG. 14. When this high voltage treatment is applied, an arc discharge occurs between second grid 14 and third grid 15 which removes flashes, burrs, and dirt from second grid 14, and the emission of unwanted electrons is thereby suppressed.

As shown in FIG. 15, however, the stem pins 4*b* of second grid 14 and cathodes 12 are disposed around stem pin 4*a* of third grid 15 with a very small spacing from it. As a result, when a high voltage of four to five times the operating voltage was applied to third grid 15, a creeping discharge occurred between stem pins 4*a* and 4*b*, and a satisfactory high voltage treatment could not be achieved.

FIG. 16 is an enlarged perspective view of a structure of a silo-type base used to prevent such a creeping discharge. It comprises a silo-type base 30 wherein the stein pin 4*a* of the third grid is partitioned from other stem pins by walls which are attached to stem 2 via silicone rubber 31. A socket shown in FIG. 17 is used for connection with silo-type base 30 of FIG. 16 for the purpose of applying a voltage to the cathode ray tube from an external power source.

Using this silo-type base 30 and socket 32, the breakdown voltage between stem pin 4*a* and the other stem pins 4*b* can be increased, but the high voltage treatment using four to five times the operating voltage could still not be performed with full satisfaction.

To solve the above problems, other high voltage treatments have been proposed, as disclosed for example in Japanese Patent Kokai Publication No. 101255/1979 wherein a high voltage is applied while maintaining at least stem 2 of cathode ray tube 20 in a high pressure gas atmosphere.

In this type of high voltage treatment, stem 2 of cathode ray tube 20 is enclosed in a sealed container 21, and a high pressure gas G is supplied to the container from outside as shown in FIG. 18, so that the threshold voltage at which creeping discharge begins on stem pins 4*a* and 4*b* is increased.

Using this method, the creeping discharge threshold voltage can be increased from about 23 kV in the conventional method to about 40 kV.

In the above method of high voltage treatment using high pressure gas, however, the creeping discharge threshold voltage was not always constant on production lines continuously manufacturing large numbers of cathode ray tubes, and creeping discharges sometimes occurred on the stem pins. In such cases, a satisfactory discharge did not occur between the second and third grid electrodes, dielectric characteristics were not consistent, and damage to the socket was caused by the energy of the discharging.

SUMMARY OF THE INVENTION

This invention was conceived to overcome the above problems. It aims to provide a method of high voltage treatment for cathode ray tubes wherein a stable creeping discharge threshold voltage is maintained. A further objective of this invention is to provide an apparatus whereby high voltage treatment can be performed safely and efficiently in a high pressure gas atmosphere.

In a method of high voltage treatment for a cathode ray tube having a neck having one end closed with a stem and housing an electron gun and stem pins for a focus electrode, and other electrodes of the electron gun, a high pressure gas atmosphere is established around the neck, and a voltage which is sufficiently higher than the operating voltage of the cathode ray tube between the stem pins when the high pressure gas atmosphere is established. The temperature of part of the stem where the stem pins are provided is maintained above the temperature of the high pressure gas atmosphere during the voltage application. Because the part of the stem, where the stem pins are provided, is heated to a higher temperature than that of the surrounding gas, the saturated vapor pressure in the area surrounding the neck therefore increases, condensation becomes more difficult, and a consistent creeping discharge threshold voltage can be maintained. Thus, a creeping discharge due to the voltage applied to the stem pins can be avoided.

In another aspect of the invention, the dew point of the high pressure gas atmosphere is set at, at most, 25° C., condensation is therefore prevented, and a consistent creeping discharge threshold voltage can be maintained. Further, a creeping discharge due to the voltage applied to the stem pins can be similarly avoided.

In a further aspect of the invention, a container is provided which has one end open, which is provided with a socket on its base, and which is provided with a seal assembly comprising a hollow annular seal member of elastic material disposed on the inner peripheral surface of the container at open end. The container is advanced toward the cathode ray tube such that the container encloses the neck and the socket in the container is connected with the stem pins of the neck. A compressed air is supplied into the hollow annular seal member so as to reduce its inner diameter such that it is pressed against the outer peripheral surface of the neck so as to form an airtight seal between the outer peripheral surface of the neck and the open end of the container. A high pressure gas is introduced into the container while the airtight seal is maintained between the outer peripheral surface of the neck and the open end of the container. Finally a voltage which is sufficiently higher than the operating voltage of the cathode ray tube is applied between the stem pins for the first and the second electrodes, via the socket to the stem pins while the neck is surrounded by the high pressure gas.

In a further aspect of the invention, a container is provided which has one open end, is provided with a first socket having pressure-contact terminals on its base, and is provided with a seal member of elastic material-fitted to said open end. A second socket having pressure-contact terminals is connected to the stem pins on the neck of the cathode ray tube, said container is advanced toward the cathode ray tube such that the seal member is pressed against the funnel of the cathode ray tube to form an airtight seal between the open end of the container and the funnel. Further, the pressure-contact terminals of the first and second sockets are contacted with each other to establish electrical connection. A high pressure gas is then introduced into the container while the air tight seal is maintained to establish a high pressure gas atmosphere around said neck. Finally, a voltage which is sufficiently higher than the operating voltage of the cathode ray tube is applied between the stem pins for the first and the second electrodes, via the pressure-contact terminals to said stem pins while said neck is surrounded by said high pressure gas.

DETAILED DESCRIPTION OF THE PREFERRED EMBODIMENTS

An embodiment of the invention will now be described with reference to the drawings.

Figure 1A:
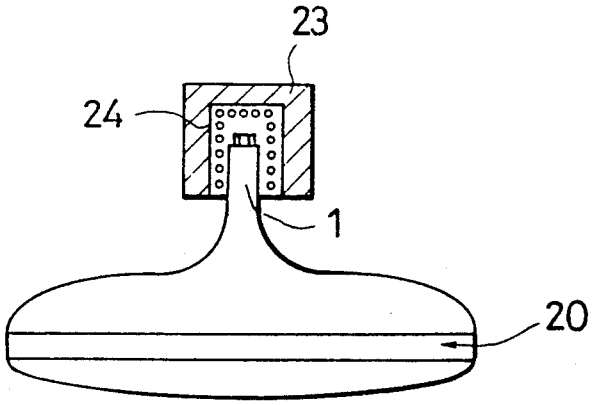
FIGS. 1(*a*) and 1(*b*) are schematic drawings to describe a method of high voltage treatment apparatus according to one embodiment of the invention.
Figure 1B:
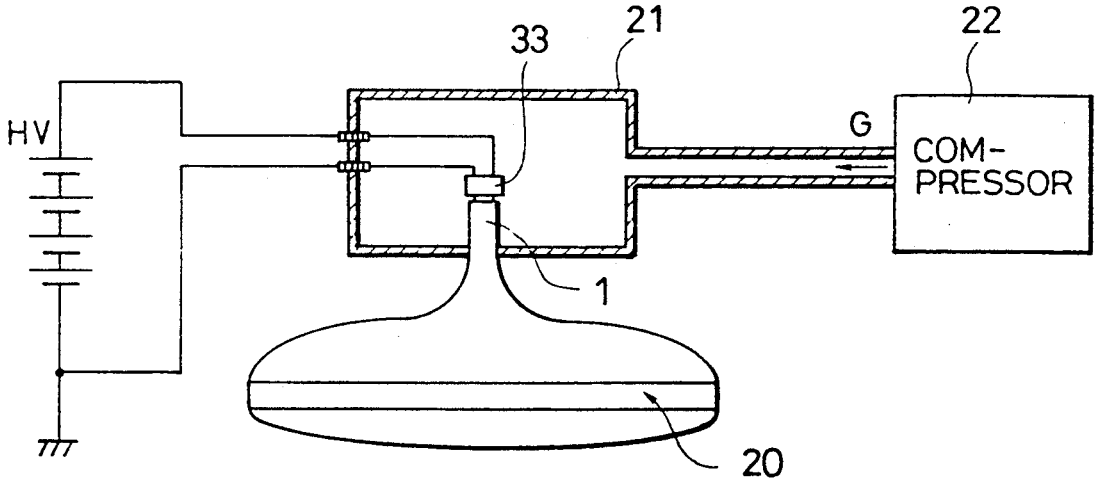

FIG. 1 is a schematic drawing for explaining a method of high voltage treatment of cathode ray tubes according to one embodiment of the invention. In the figure, the cathode ray tube 20 has a neck 1 housing an electron gun. A socket 33 is used to supply voltage from outside to the electron gun 10 of cathode ray tube 20. A sealed container 21 is provided to for forming a high pressure gas atmosphere around neck 1 of the cathode ray tube 20, in a manner to be described later. A compressor 22 produces compressed air. Further, a heating furnace 23 is provided with a heating element 24 disposed therein.

The procedure of the high voltage treatment of this embodiment will now be described.

The neck 1 of cathode ray tube 20 which has been evacuated is placed in furnace 23 as shown in Fig. 1(*a*), and an electric current is passed through heating element 24 so as to heat the neck. The ambient temperature in furnace 23 is set at 160° C. By exposing neck 1 of cathode ray tube 20 to this high temperature for 5 minutes, the surface temperature of the neck, particularly that part of the stem where stem pins are provided, which has a diameter of 29 mm, is raised to about 90° C.

Next, neck 1 is introduced In sealed container 21 as shown in Fig. 1(*b*), and high voltage treatment is performed in the high pressure gas atmosphere. For this purpose, compressed air, at about 2 atm, produced by compressor 22, is supplied to sealed container 21 so as to produce a high pressure gas atmosphere of about 2 atm. Next, a high DC voltage of about 30 kV is applied for about 5 minutes between third grid stem pin 4a and stem pins 4b of the electrodes other than the third grid, which serves as a focus electrode.

Figure 2:
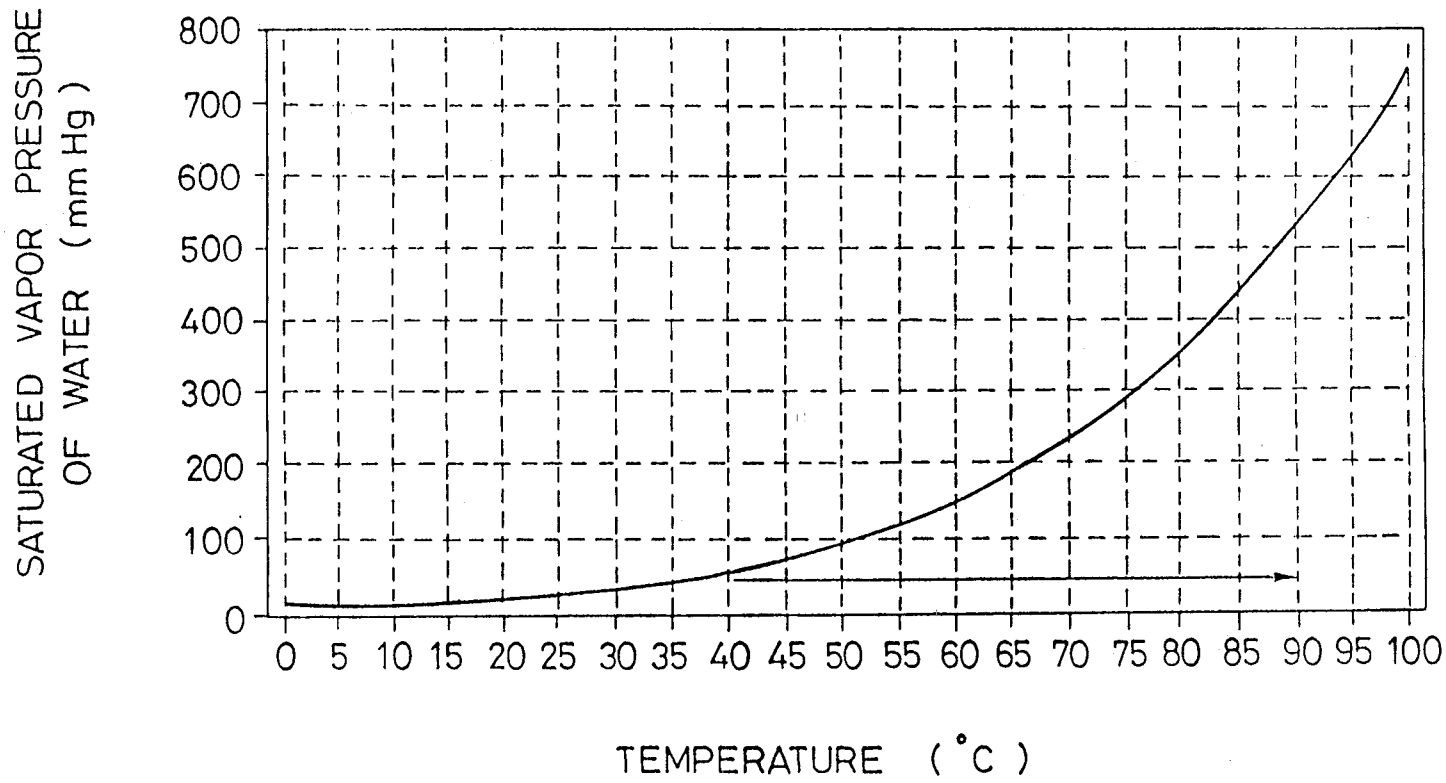
FIG. 2 is a diagram showing the saturated vapor pressure of water.

If for example the outside temperature is as high as 40° C. and the relative humidity is as high as 95%, the humidity of sealed container 21 is higher than 100%, and condensation occurs inside container 21 and on the surface of cathode ray tube 20. As neck 1 is heated to 90° C. which is much higher than the temperature of the atmosphere in container 21, however, the relative humidity in the region of neck 1 is about 9%, as will be seen from the saturated vapor pressure curve of FIG. 2. Although the air pressure In container 21 is 2 atm, therefore, the relative humidity does not exceed 100% and condensation does not occur.

Figure 3:
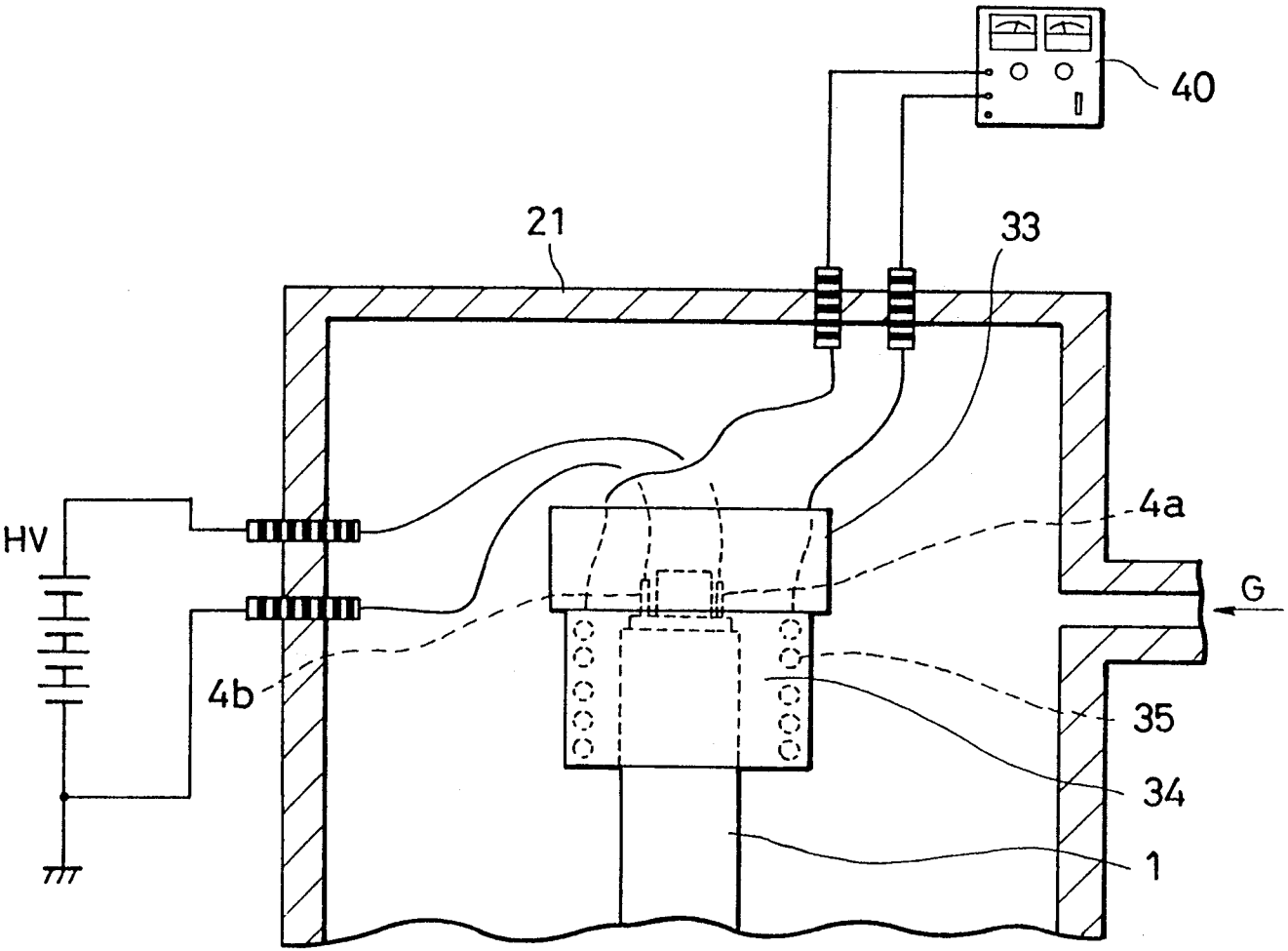
FIG. 3 is a partial enlarged section showing a specific arrangement of the high voltage cathode ray tube treatment apparatus of the invention.

FIG. 3 is a schematic drawing showing a specific example of an apparatus used to implement the high voltage cathode ray treatment of the above embodiment. As illustrated it comprises a socket 33, a heater 34 installed in socket 33, a heating element 35 arranged in heater 34, a high voltage power source HV for applying high voltage to the electrodes of the electron gun via socket 33, and a heating power source 40 to heat element 35.

The operation of this embodiment will now be described.

An electric current is kept flowing through heating element 35 of heater 34 in socket 33 so as to maintain the temperature inside heater 34 at about 160° C. Next, neck 1 of cathode ray tube 20 is introduced into sealed container 21, and socket 33 is connected with stem pins 4a and 4b. The system is then left in this condition for 5 minutes to raise the temperature of neck 1 to about 90° C., and the atmosphere in container 21 is made a high pressure gas atmosphere of about 2 atm. By making the atmosphere in container 21 a high pressure atmosphere, condensation would be rendered easier, but in this apparatus a heater is provided to heat the neck 1. The saturated vapor pressure in the region of neck 1 therefore increases, condensation does not occur on socket 33 to which high voltage is applied, and a stable creeping discharge voltage is maintained.

In the above embodiment, neck 1 was heated by a heater 34 in furnace 23, which is removed before introduction of neck 1 into sealed container 21. The invention however is not limited to this arrangement.

Figure 4:
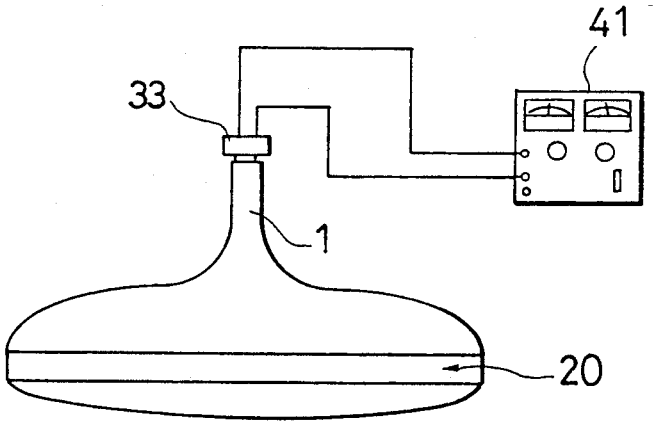
FIGS. 4(*a*) and 4(*b*) and FIG. 5 are schematic drawings to describe the methods of high voltage cathode ray treatment in different embodiments of the invention.
Figure 4:
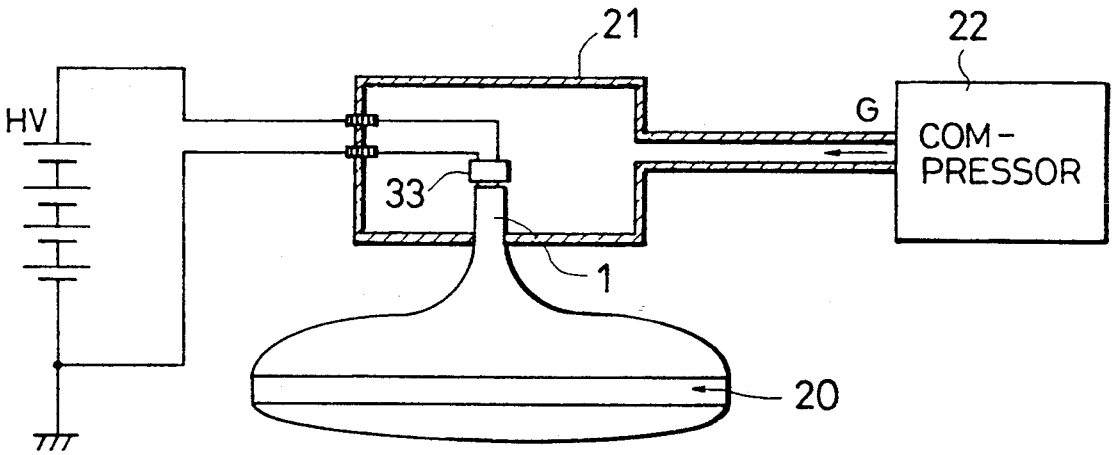

FIG. 4 is a drawing showing another embodiment of the invention. In FIG. 4(*a*), there is provided a heating power source 41 for the electron gun. A voltage from the heating power source 41 is applied to the heater of the gun. If for example neck 1 has a diameter of 29 mm, the heater rating is 6.3 V-680 mA and a voltage of 8 V is applied to the electron gun for about 5 minutes, the surface temperature of neck 1 rises to about 90° C.

In the above embodiments, neck 1 is heated in advance until immediately before placing it in the high pressure gas atmosphere. If the temperature of neck 1 gradually falls during the high voltage treatment and the treatment is performed for a long period of time, condensation may gradually form. If for example a neck which has been heated to 90° C. is left at 25° C. in an atmosphere at a pressure of 2 atm., the surface temperature of neck 1 falls to 35° C.

Figure 5:
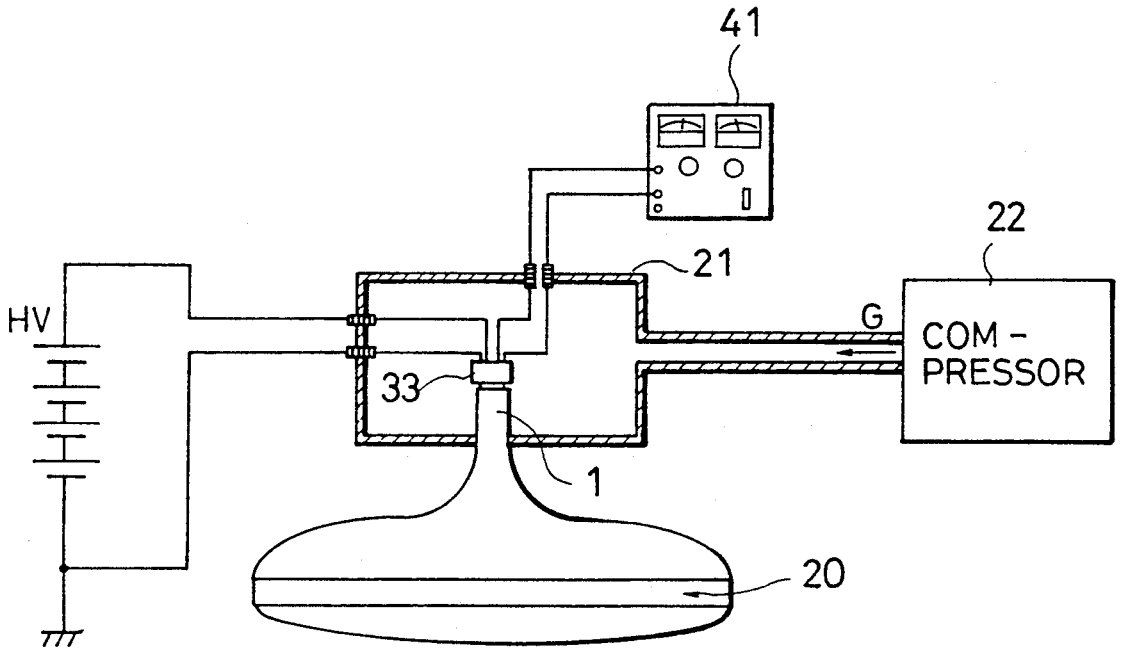

FIG. 5 is a drawing of another embodiment conceived to overcome the above disadvantage. As illustrated, a heating power source 41 is kept connected to the heater of the electron gun while at the same time the high voltage is applied from a high voltage power source HV to the stem pins for the third grid and other electrodes. Accordingly, it is ensured that the temperature of the neck of the cathode ray tube be maintained at a desired value throughout the high voltage treatment.

Figure 6:
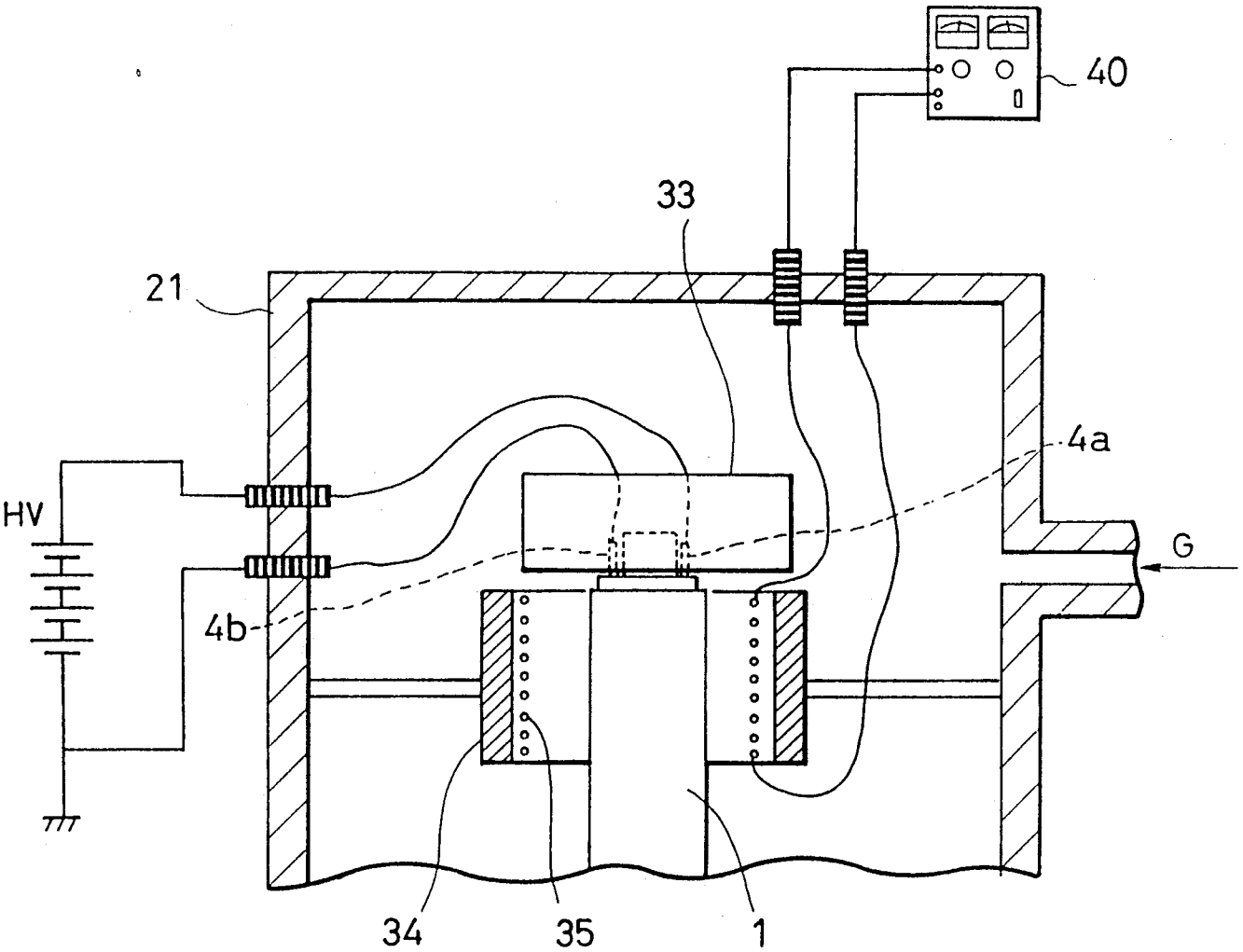
FIG. 6 is a schematic drawing showing another arrangement of the high voltage cathode ray tube treatment apparatus according to the invention.

FIG. 6 is a drawing of another embodiment of the invention wherein a heater 34 with a heating element 35 is disposed in sealed container 21.

Instead of heating element 35 consisting of, for example, Nichrome (trademark, nickel-base alloy, containing chromium and iron) wire, a radiating heating system including an infrared lamp may also be used.

Further, in the above embodiments, compressed air was used as the high pressure gas. The gas however need not necessarily be air, and other gases, for example a non-combustible gas such as nitrogen, may be used instead.

Further, if dehumidification is carried out prior to introducing high pressure gas into the container, the dew point falls and the temperature to which the neck is raised may be lowered.

Figure 7:
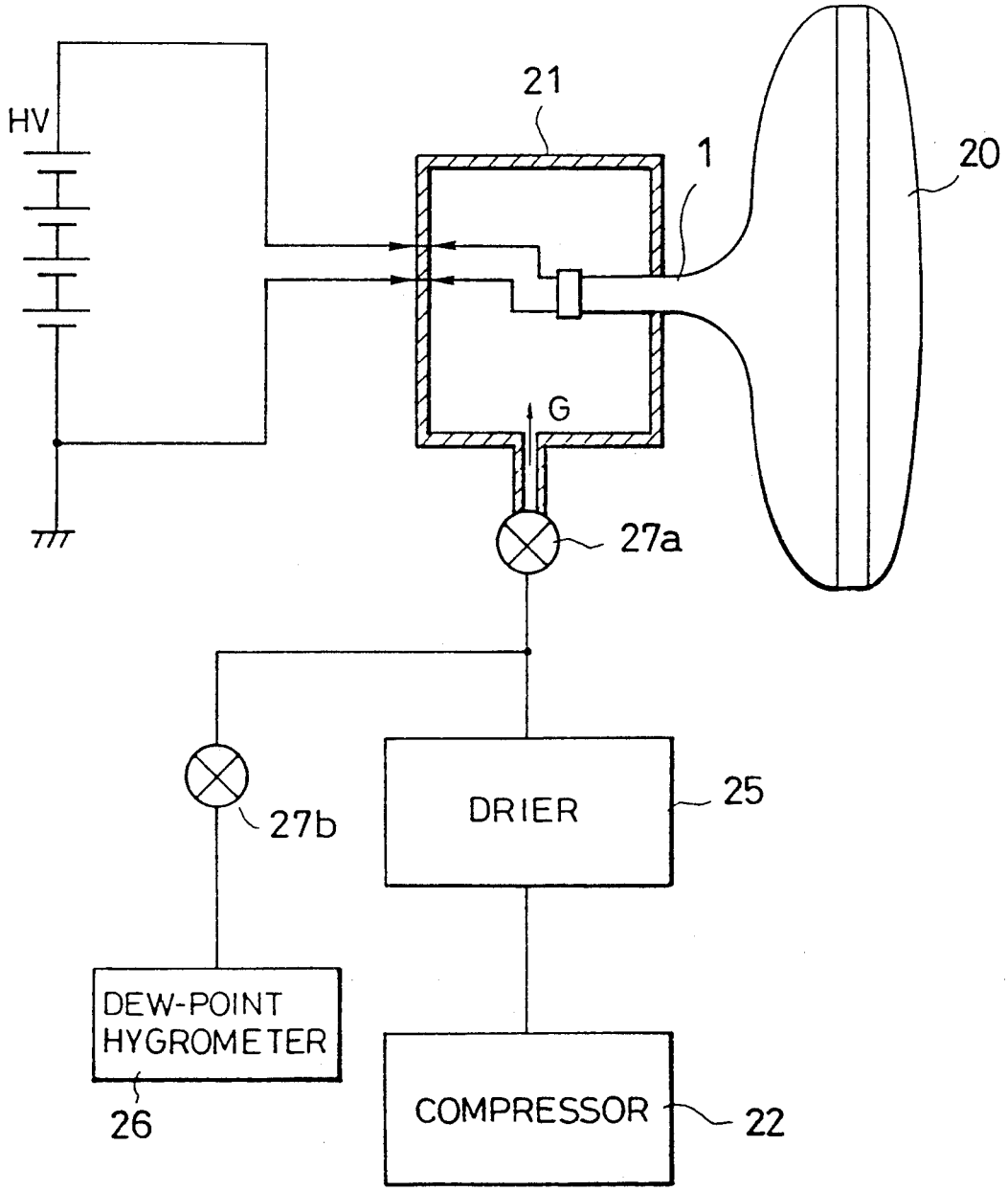
FIG. 7 is a schematic drawing to describe a method of high voltage cathode ray treatment in another embodiment of the invention.

FIG. 7 is a drawing to describe the high voltage treatment of this method. In the figure, a drier 25 which is packed with molecular sieve or the like is provided to dry the compressed air, a dew-point hygrometer 26 is provided to measure the dew point of the compressed air which his passed through drier 25, and valves 27a, 27b are provided to control the flow of the gas.

The operation will now be described. Atmospheric air is compressed to about 2 atm by compressor 22, and water vapor is removed by drier 25. Compressed air dried by drier 25 is led to dew-point hygrometer 26 via valve 27b, and its dew point is measured. The dew point is measured at atmospheric pressure. Compressed air of which the dew point has been confirmed to be no higher than 25° C. by hygrometer 26 is led into container 21 via valve 27a. When container 21 is at a high pressure, a high DC voltage of about 30 kV is applied for about 5 minutes between the third grid and the electrodes other that the third grid. As the socket is then surrounded by a high pressure gas atmosphere with no condensation, the creeping discharge threshold voltage is no less than 35 kV. A discharge therefore occurs between the third grid and second grid, flashes, burrs, and dirt are removed from the second grid, and a cathode ray tube is obtained with satisfactory dielectric properties wherein unnecessary emission of electrons from the second grid is suppressed.

The reason why the dew point was set to be no higher than 25° C. will next be described.

The authors of the present invention found that on mass production lines, creeping discharge threshold voltage in the stem pin area tended to decrease especially during the rainy season of high temperature and high humidity, and that it was very effective to reduce the amount of moisture in the high pressure gas atmosphere.

Figure 8:
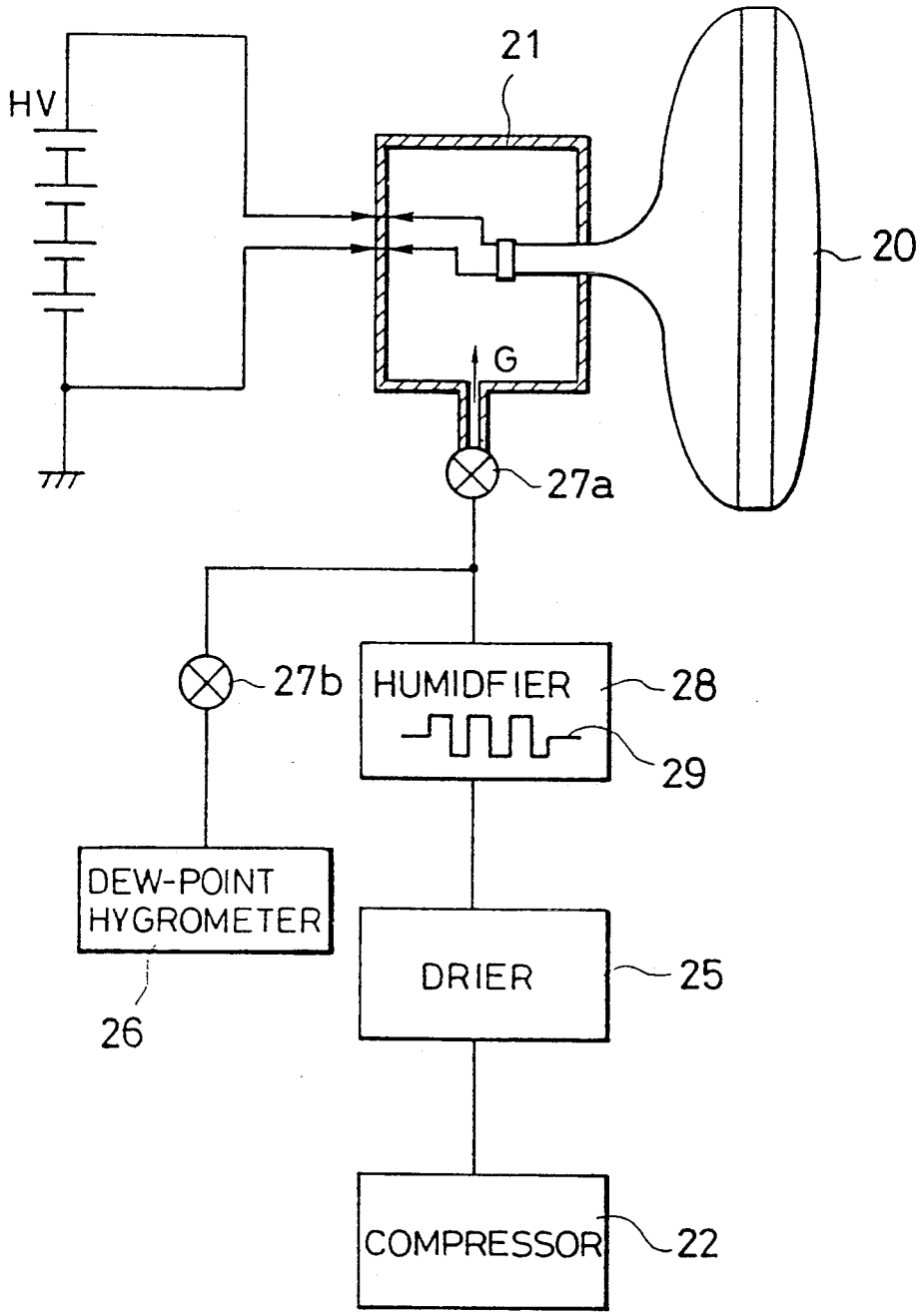
FIG. 8 is a schematic drawing of an experimental device used to determine the relation between dew point and creeping discharge threshold voltage.

FIG. 8 is an experimental device for the purpose of experimentally establishing the relation between dew point and creeping discharge threshold voltage. In the figure, a humidifier 28 is provided with a heater 29 to control the degree of humidification. The dew point can be set freely by adjusting the temperature of the high pressure gas with heater 29.

Figure 9:
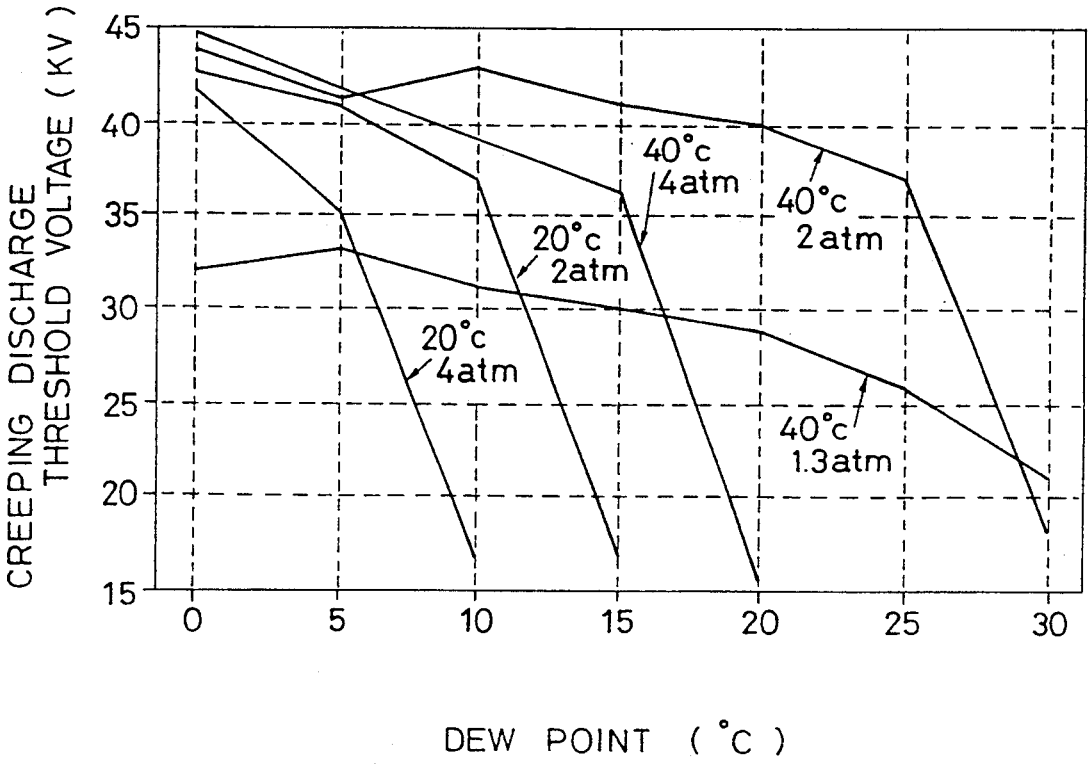
FIG. 9 is a graph showing the relation between dew point and creeping discharge threshold voltage.

FIG. 9 shows the results of an experimental study of the relation between dew point and creeping discharge threshold voltage in the stem pin area using this experimental device. As is seen from the figure, when the room temperature is 40° C. and the pressure in container 21 is 2 atm, the creeping discharge threshold voltage is only about 18 kV when the dew point is 30° C. When the dew point is 25° C. or less, however, the creeping discharge threshold voltage increases. Further, at 20° C. or below it is stable at 40 kV.

Further, if the pressure inside container 21 was set at 4 atm, the desired effect was obtained when the dew point was 15° C. or less.

Further, if the room temperature was of the order of 20° C. as in winter, the dew point had to be 10° C. or less. Further, if the air pressure in container 21 was set at 1.3 atm, there was no improvement of creeping discharge threshold voltage even if the dew paint were lowered.

Figure 10:
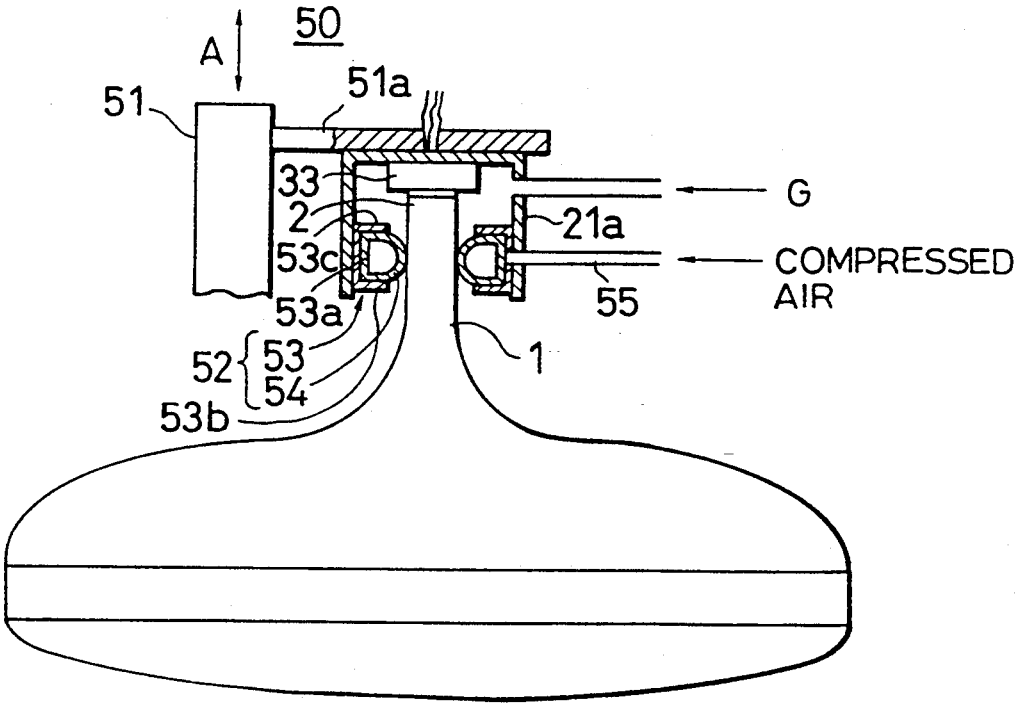
FIG. 10 is a sectional view showing a device for attaching and detaching the airtight container to and from the cathode ray tube in the high voltage treatment apparatus according to a further embodiment of the invention.

FIG. 10 is a drawing showing a further embodiment of the invention, and concerns the attaching/detaching device for the airtight container enclosing the cathode ray tube.

In the figure, an assembly 50 is for attaching and detaching a container 21*a*, and includes an advancing-/retreating device 51 driven by a drive device (not shown) which moves container 21*a* forwards or backwards in directions A, a container 21*a* fitted to the arm 51*a* of this advancing/retreating device 51 and having one end opened, a socket 33 on the base of this container 21*a*, and a seal assembly 52 arranged on the inner peripheral surface of the open end of container 21*a*. Seal assembly 52 includes a supporting member 53 having a cylindrical wall 53*a* attached to the inner peripheral surface of the open end of container 21*a*, first and second flanges 53*b* and 53*c* extending inwards from first and second (lower and upper, as seen in the figure) edges of the cylindrical wall 53*a* to form an annular opening between the inner edges of the first and second flanges 53*b* and 53*c*. Seal assembly 52 further includes a hollow annular seal member 54 of elastic material such as rubber fitted inside supporting member 53. It is further provided with an air duct 55 in communication with seal member 54 for supplying compressed air. When compressed air is supplied into seal member 54, its inner diameter is reduced. Therefore, if the neck 1 has been inserted through seal member 54, seal member 54 is pressed against neck 1 to form an airtight seal between them. When compressed air is removed from seal member 54, its inner diameter is enlarged, and neck 1 is separated from seal member 54 and the airtight seal between them is broken.

The operation will now be described. To perform the high voltage treatment, container 21*a* is moved toward the cathode ray tube 20 to enclose the container 21*a* so as to connect socket 33 to the stem pins without supplying compressed air to seal member 54. As seal member 54 is not inflated, insertion is facile. Compressed air is then sent via duct 55 into seal member 54 to inflate seal member 54, i.e., reduce its inner diameter toward neck 1 and to make an airtight seal between neck 1 and member 54. High pressure gas is then introduced into container 21*a*. In this process, it is desirable that the air pressure in seal member 54 is adjusted to be higher than the high gas pressure in container 21*a*.

Further, container 21*a* is pressed towards the cathode ray tube by advancing/retreating device 51 so that it does not detach from the neck. Under these conditions, a high voltage of four to five times the operating voltage of the cathode ray tube is applied from outside via socket 33 between third grid 15 and other electrodes (including second grid 14), to remove burrs or flashes formed on the second grid. The compressed air in seal member 54 is then removed to deflate the member, and advancing/retreating device 51 is withdrawn so as to detach container 21*a* from cathode ray tube 20.

In this embodiment, container 21*a* only has to enclose socket 33, stem 2 and part of neck 1. The apparatus can therefore be made compact and the pressure acting on the whole of container 21*a* is smaller. Thus, there is less risk of explosion.

Further, the assembly can be sealed or unsealed by supplying or removing compressed air to or from seal member 54. Attachment and detachment of container 21*a* is therefore facile, and operations are easier to perform.

Seal assembly 52 may alternatively be of such a configuration using a magnet for the sealing. But as in this case the neck 1 is close to ground potential, there is a high risk that the neck glass insulation will break down during high voltage treatment. If compressed air is used as in this embodiment, however, there is no such a risk and a safe apparatus is obtained.

Figure 11:
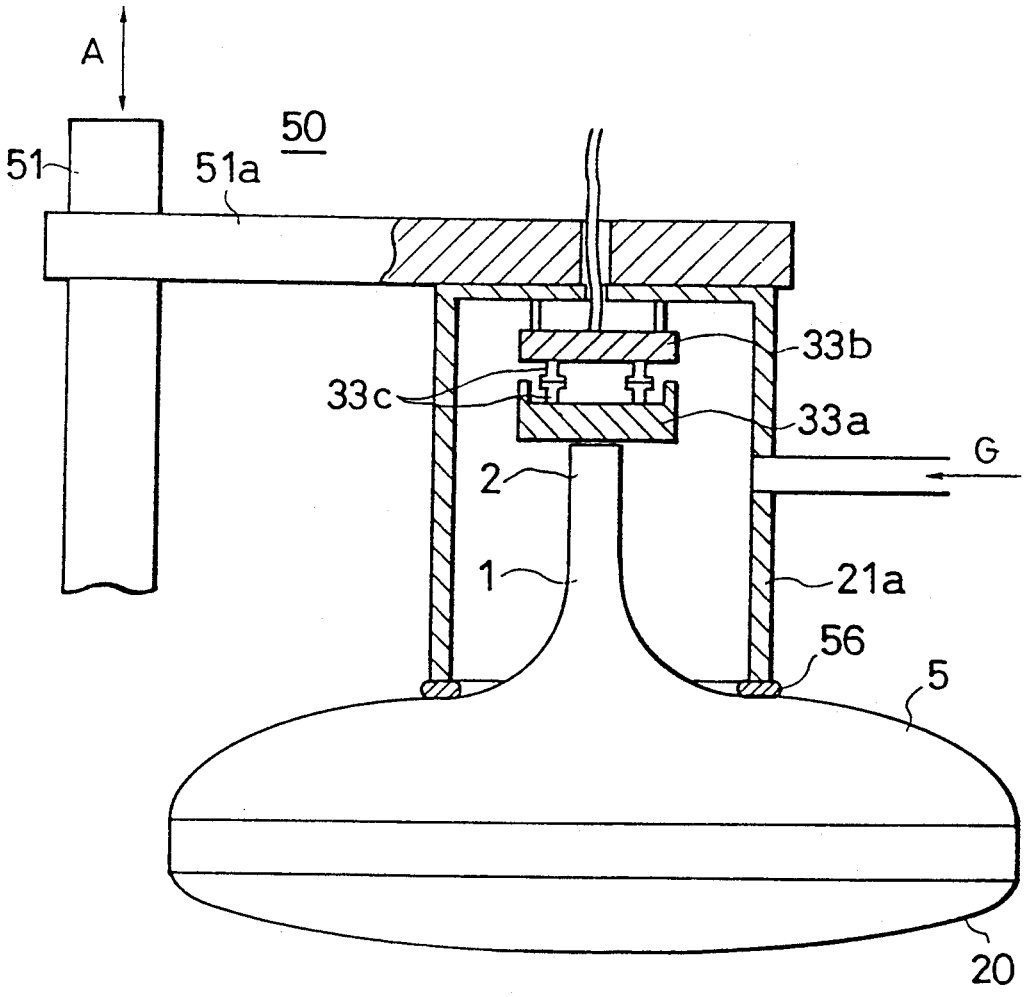
FIG. 11 is a sectional view showing an attaching-/detaching device according to a further embodiment of the invention.
Figure 12:
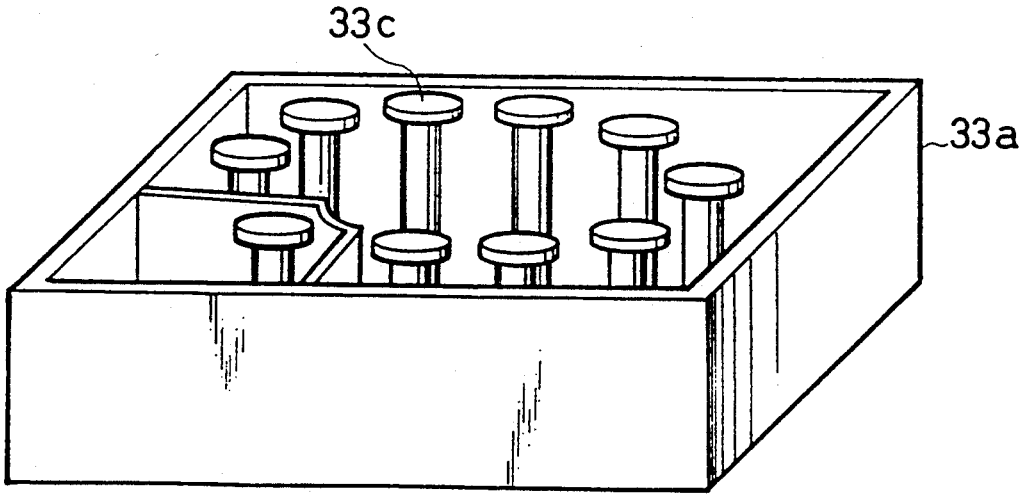
FIG. 12 is a perspective view showing the structure of the socket in this embodiment.
Figure 13:
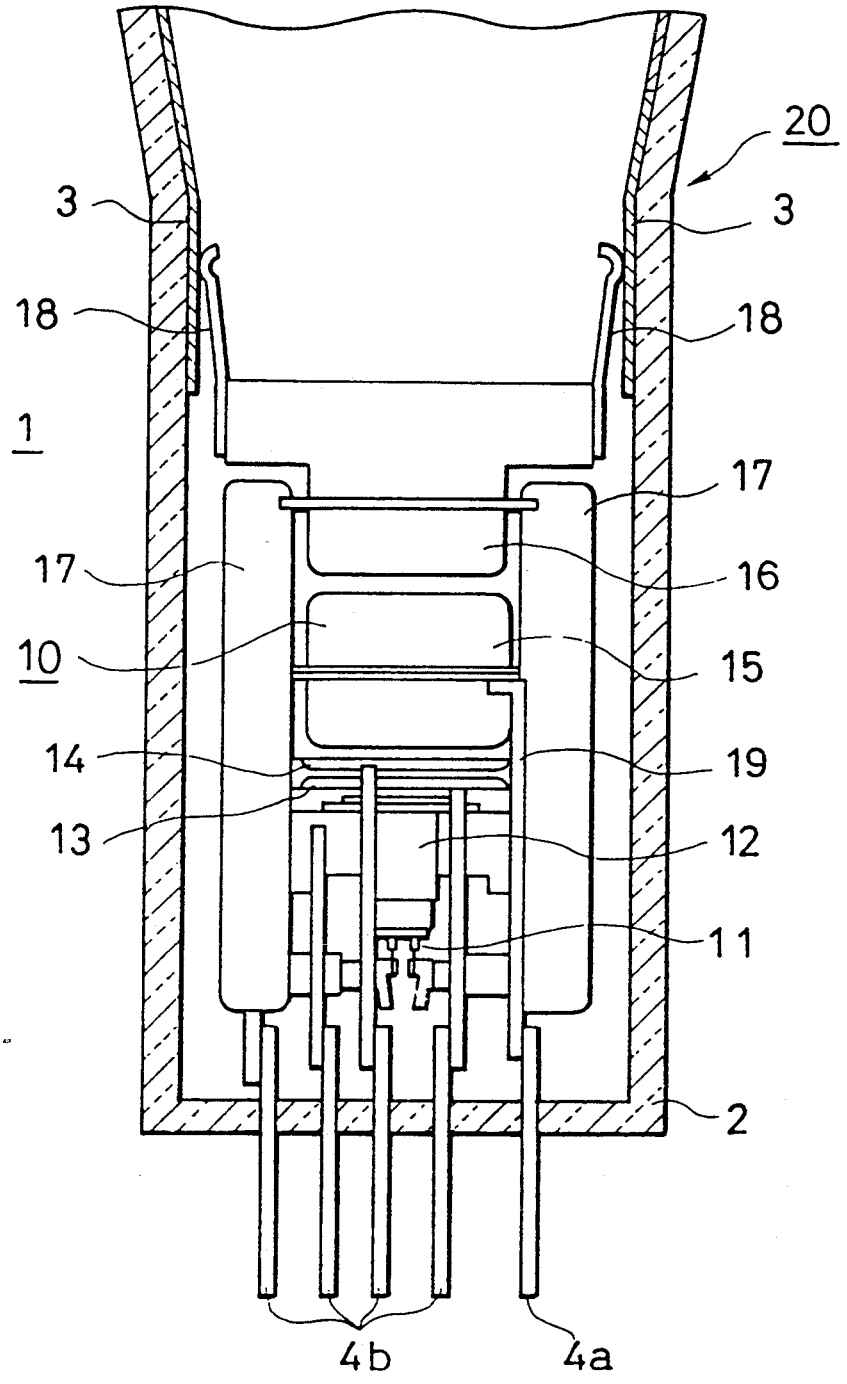
FIG. 13 PRIOR ART
FIG. 13 is a sectional view of the neck of a color cathode ray tube.
Figure 14:
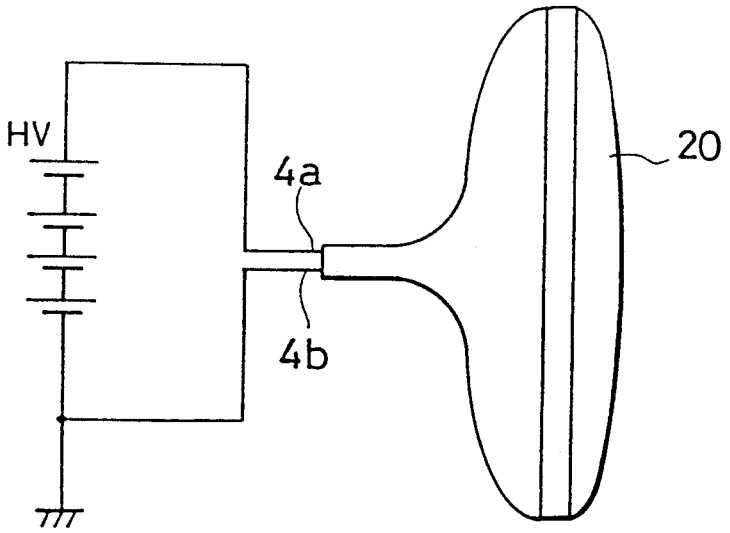
FIG. 14 PRIOR ART
FIG. 14 is a schematic drawing of the method of high voltage treatment.
Figure 15:
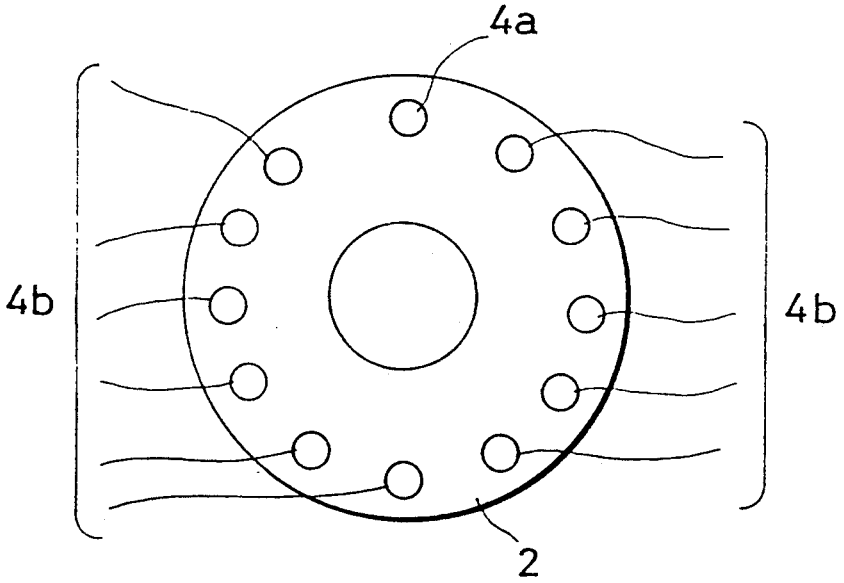
FIG. 15 PRIOR ART
FIG. 15 is a drawing showing the arrangement of stem pins in a color cathode ray tube.
Figure 16:
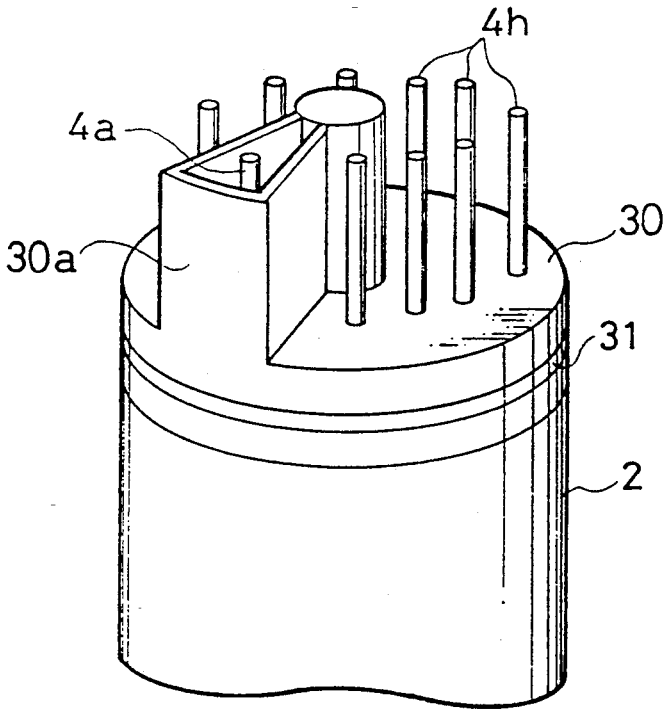
FIG. 16 PRIOR ART
FIG. 16 is an enlarged perspective view showing the structure of the silo-type base.
Figure 17:
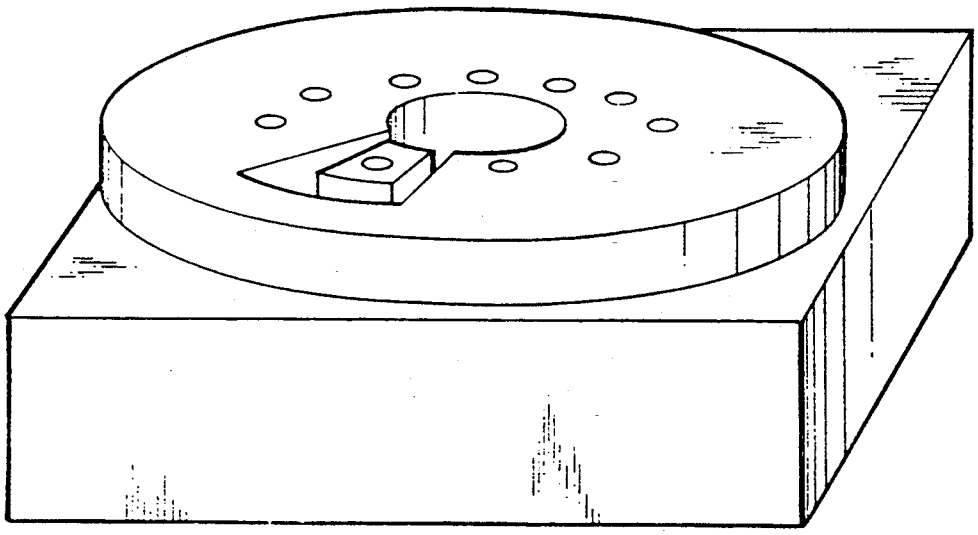
FIG. 17 PRIOR ART
FIG. 17 is an enlarged perspective view of the socket the silo-type base.
Figure 18:
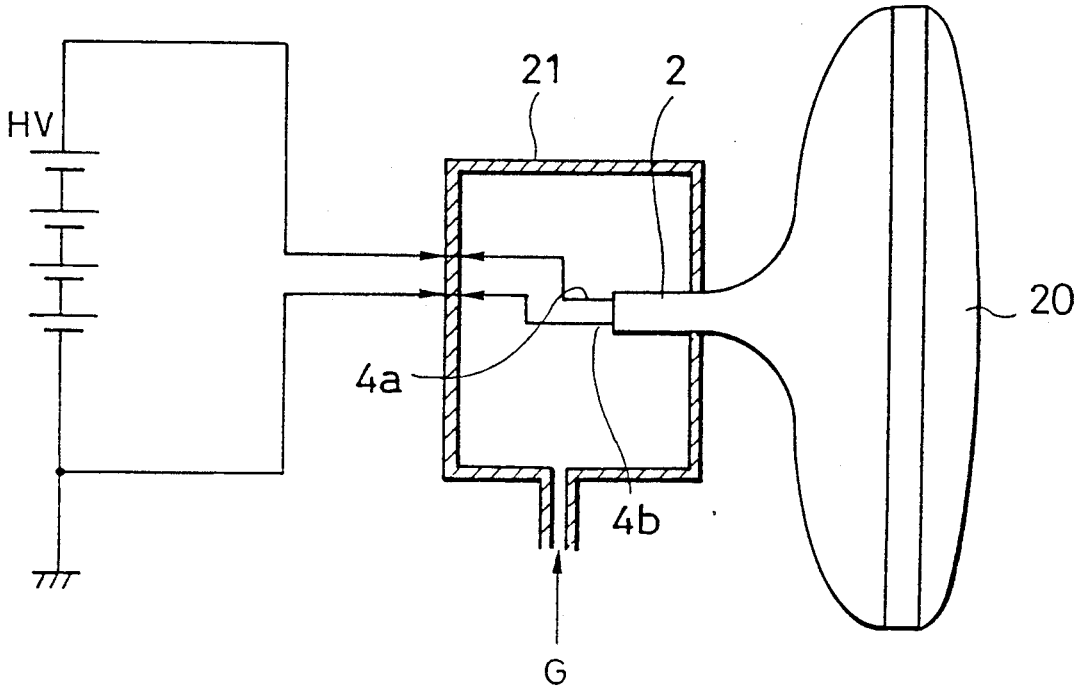
FIG. 18 PRIOR ART
FIG. 18 is a schematic drawing to describe the conventional method of high voltage treatment.

FIG. 11 is a drawing of one embodiment of the container attaching/detaching device in the high voltage treatment apparatus of a further embodiment in the invention, and FIG. 12 is a drawing showing the structure of the socket in this embodiment.

In the figures, a seal member 56 is formed of an elastic material such as rubber fitted to the surface of the open end of container 21*a* which is pressed by advancing/retreating device 50 against funnel 5 of cathode ray tube 20 so as to seal container 21*a* airtight. A first socket 33*a* is fitted to base 2 of cathode ray tube 20, and a second socket 33*b* is fitted to the base of container 21*a*. These sockets are both provided with pressure-contact terminals 33*c* such that when container 21*a* is pressed by advancing/retreating device 51 to seal the space between it and funnel 5, opposite pairs of pressure-contact terminals are brought into electrical contact so that power can be supplied via them from an external source to the stem pins on neck 1.

The operation will now be described. Container 21*a* is advanced by advancing/retreating device 51 so as to enclose neck 1 of cathode ray tube 20 which has already been fitted with second socket 33. At the same time, seal member 56 is pressed against funnel 5 to form an airtight seal, and the pressure-contact terminals 33*c* of first socket 33*a* and second socket 33*b* are brought into contact.

High pressure gas is then supplied to container 21*a* and when the specified gas pressure has been reached, a voltage of four to five times the operating voltage of the cathode ray tube is applied between third grid 15 and other electrodes (including second grid 14) via first socket 33*b* so as to remove burrs and flashes formed on second grid 14. High pressure gas is then removed from container 21*a*, advancing/retreating device 51 is retracted, and container 21*a* is detached from cathode ray tube 20.

In this embodiment, first socket 33*a* has to be fitted to the cathode ray tube in advance. Container 21*a* can however be attached to or detached from neck 1 in a single operation, and a high voltage treatment apparatus which is easy to manipulate is therefore obtained.

In the embodiments described, four grids are provided in the electron gun of the CRT, and the high voltage is applied between the third grid and other electrodes. In another type of CRT, the electron gun is provided with six grids and the third and the fifth grids are connected to each other to serve as focus electrodes. In such a CRT, the high voltage is applied between, on one hand, the third and the fifth grids and, on the other hand, other electrodes.

The terms "first electrode" and "second electrode" as used in the appended claims should not be confused with the first grid and the second grid as referred to in the description of the embodiments.

In one aspect of the invention, when the high voltage treatment is performed in the high pressure gas atmosphere, the temperature of part of the stem where the stem pins are provided is raised above that of the temperature of the high pressure gas. The fall of creeping discharge threshold voltage can therefore very simply be avoided, and a cathode ray tube of consistent quality can be obtained. In addition, damage to the socket can be prevented, and productivity can be increased.

In another aspect of the invention, the dew point of the high pressure gas atmosphere is no higher than 25° C., and the same effects as those described above are obtained.

In a further aspect of the invention, a socket is fitted to the base of a container with one open end, this container is supported by an advancing/retreating device which advances it so as to cover the neck of the cathode ray tube and bring the corresponding stem pins into contact with the socket. Compressed air is supplied to the hollow annular seal member supported on the inner peripheral surface of the open end of the container so as to make an airtight seal with the outer peripheral surface of the neck, and high pressure gas is supplied to the container. Then high voltage treatment is performed. The compressed air is then withdrawn to break the seal, and the advancing/retreating device is operated to detach the container. This permits efficient attachment and detachment of the high voltage treatment apparatus from the neck of the cathode ray tube.

In a further aspect of the invention, the open end of the container is provided with a seal member, the neck of the cathode ray tube is enclosed by the container by means of the advancing/retreating device, and the seal member is pressed against the funnel so as to make an airtight seal. At the same time, the stem pins and external power source are brought into contact via a socket provided with pressure-contact terminals. A high voltage treatment apparatus is therefore obtained.

From the above-described embodiments of the present invention, it is apparent that the present invention may be modified as would occur to one of ordinary skill in the art, without department from the spirit and scope of the present invention, which should be defined solely by the appended claims. Changes and modifications of the system contemplated by the present preferred embodiments will be apparent to one of ordinary skill in the art.

What is claimed is:

1. An apparatus for implementing high voltage treatment for a cathode ray tube, comprising:

a container, including a base and one end open, including a socket on the base;

an advancing/retreating device for supporting the container, for moving the container along an axis of the cathode ray tube in a forward direction until the container encloses a neck of the cathode ray tube, and for moving the container in a backward direction to free the neck from the container;

a seal assembly including a hollow annular seal member of an elastic material disposed on an inner peripheral surface of the container at the open end, wherein an inner diameter of the seal assembly is reduce when compressed air is supplied to its interior, the seal assembly thereby being pressed against an outer peripheral surface of the neck so as to form an airtight seal between the outer peripheral surface of the neck and the open end of the container;

means for introducing a high pressure gas into said container after the airtight seal has been formed between the outer peripheral surface of the neck and the open end of the container; and means for applying a voltage, via the socket, to stem pins of the cathode ray tube while the neck is surrounded by said high pressure gas.

2. An apparatus for implementing high voltage treatment for a cathode ray tube, comprising:

a container including an interior and one open end to permit high pressure gas to be supplied to the interior, the container being connected to a socket with a base, the socket including pressure-contact terminals on the base;

a seal member of an elastic material fitted to the open end of the container;

an advancing/retreating device for supporting said container, for moving the container along an axis of the cathode ray tube in a first direction until the seal member is pressed against a funnel portion of the cathode ray tube thereby forming an airtight seal between the open end of the container and the funnel portion of the cathode ray tube, wherein the pressure-contact terminals of the socket are brought into contact with pressure-contact terminals connected in advance to stem pins of a neck portion of the cathode ray tube, and for moving the container in a second direction until the seal member is separated from the funnel portion of the cathode ray tube, wherein the pressure-contact terminals of the socket are separated from the pressure-contact terminals connected to the stem pins;

means for introducing a high pressure gas into the container after the air tight seal has been formed; and means for applying a voltage, via the contacted pressure-contact terminals, to the stem pins after the neck of the cathode ray tube has been surrounded by the introduced high pressure gas.

3. An apparatus for implementing high voltage treatment for a cathode ray tube, including a neck having one end closed with a stem, and housing an electron gun including at least first and second electrodes, and first and second stem pins, external to the cathode ray tube neck and housing, for the first and second electrodes, the apparatus comprising:

first means for establishing a high pressure gas atmosphere around the neck;

second means for applying a voltage which is sufficiently higher than an operating voltage of the cathode ray tube between the first and second stem pins after establishing the high pressure gas atmosphere; and a heating source external to the cathode ray tube neck and housing, for externally heating the part of the stem containing the first and second stem pins, above a temperature of the high pressure gas atmosphere, to thereby prevent a creeping discharge external to the cathode ray tube neck and housing due to the voltage applied to the first and second stem pins.

4. The apparatus of claim 3, wherein said second means for applying a voltage is for causing an arc discharge across the electrodes to remove burrs, flashes or dirt which may be present on the electrodes.

5. The apparatus of claim 3, wherein the voltage applied by the second means is four to five times the voltage applied across the electrodes during operation of the cathode ray tube.

6. The apparatus of claim 3, wherein the first electrode is a focus electrode;

the electron gun includes a plurality of electrodes, other than the focus electrode;

the neck includes, in addition to the first stem pin, stem pins for the other electrodes; and said second means applies the voltage between the first stem pin and the stem pins for the other electrodes.

7. The apparatus of claim 3 wherein the part of the stem containing the first and second stem pins is externally heated above a temperature of the high pressure gas atmosphere prior to voltage application to maintain the temperature above the temperature of the high pressure gas atmosphere.

8. The apparatus of claim 3 wherein the part of the stem containing the first and second stem pins is externally heated above a temperature of the high pressure gas atmosphere during voltage application to maintain the temperature above the temperature of the high pressure gas atmosphere.

9. The apparatus of claim 8, wherein the part of the stem containing the first and second stem pins is heated using a heater as the external heating source to maintain the temperature above the temperature of the high pressure gas atmosphere.

10. A high voltage treatment apparatus for a cathode ray tube including a neck having one end closed with a stem, and housing an electron gun including at least first and second electrodes and first and second stem pins for the first and second electrodes, the apparatus comprising:

first means for establishing a high pressure gas atmosphere around the neck;

second means for applying a voltage, which is sufficiently higher than an operating voltage of the cathode ray tube, between the first and second stem pins after establishing the high pressure gas atmosphere; and third means for setting the dew point of the high pressure gas atmosphere at a temperature of, at most, 25° C., to thereby prevent a creeping discharge from the voltage applied to the first and second stem pins, wherein said third means for setting the dew point includes means for heating the high pressure gas before it is supplied to surrounding of the neck.

11. The apparatus of claim 10, wherein said second means for applying a voltage is for causing an arc discharge across the first and second electrodes to remove burrs, flashes or dirt which may be present on the first and second electrodes.

12. The apparatus of claim 10, wherein the voltage applied by the second means is four to five times a voltage applied across the first and second electrodes during operation of the cathode ray tube.

13. The apparatus of claim 10, wherein the first electrode includes a focus electrode;

the electron gun includes a plurality of electrodes other than the focus electrode;

the neck includes, in addition to the first stem pin, stem pins for the other electrodes; and said second means applies the voltage between the first stem pin and the stem pins for the other electrodes.

14. A high voltage treatment apparatus for a cathode ray tube including a neck having one end closed with a stem, and housing an electron gun including first and second electrodes, and first and second stem pins for the first and second electrodes, the apparatus comprising:

a container which has one end open, which is provided with a socket on its base, and which is provided with a seal assembly including a hollow annular seal member of elastic material disposed on an inner peripheral surface of the container at the open end;

first means for advancing the container toward the cathode ray tube such that the container encloses the neck and the socket and the container is connected with the first and second stem pins of the neck;

second means for supplying compressed air into the hollow annular seal member so as to reduce its inner diameter such that it is pressed against an outer peripheral surface of the neck so as to form an airtight seal between the outer peripheral surface of the neck and the open end of the container;

third means for introducing a high pressure gas into the container while said airtight seal is maintained between the outer peripheral surface of the neck and the open end of the container; and fourth means for applying a voltage which is sufficiently higher than an operating voltage of the cathode ray tube, between the first and second stem pins, via the socket to the stem pins, while the neck is surrounded by the high pressure gas.

15. The apparatus of claim 14, further comprising:

fifth means for retreating the container from the cathode ray tube until the container seal member is separated from a funnel of the cathode ray tube and pressure-contact terminals of a first socket are separated from pressure-contact terminals of second sockets.

16. A high voltage treatment apparatus for a cathode ray tube, including a neck having one end closed with a stem, and housing an electron gun including first and second electrodes, and first and second stem pins for the first and second electrodes, the apparatus comprising:

a first socket having pressure-contact terminals, connected to the first and second stem pins on the neck of the cathode ray tube;

first means for advancing a container, which has one open end and is provided with a second socket having pressure contact terminals on its base and a seal member of elastic material fitted to the open end, toward the cathode ray tube such that the seal member is pressed against a funnel of the cathode ray tube to form an airtight seal between the open end of the container and the funnel, and the pressure-contact terminals of the first and second sockets are contacted with each other to establish electrical connection;

second means for introducing a high pressure gas into the container while the air tight seal is maintained to establish a high pressure gas atmosphere around the neck; and third means for applying a voltage, which is sufficiently higher than an operating voltage of the cathode ray tube, between the first and second stem pins for the first and said second electrodes, via the pressure-contact terminals to the first and second stem pins while the neck is surrounded by the high pressure gas.

17. The apparatus of claim 16, further comprising:

fourth means for retreating the container from the cathode ray tube until the container seal member is separated from the funnel, and the pressure-contact terminals of the first socket are separated from the pressure-contact terminals of the second sockets.

* * * * *